United States Patent [19]

Minami et al.

[11] Patent Number: 4,904,818

[45] Date of Patent: Feb. 27, 1990

[54] SIZING AGENTS FOR CARBON FIBERS

[75] Inventors: Hiroshi Minami; Keita Inoue, both of Aichi, Japan

[73] Assignee: Takemoto Yushi Kabushiki Kaisha, Aichi, Japan

[21] Appl. No.: 252,267

[22] Filed: Sep. 30, 1988

[51] Int. Cl.[4] ..... C07C 69/80

[52] U.S. Cl. ..... 560/85; 528/176; 560/86

[58] Field of Search ..... 560/85, 86

[56] References Cited

U.S. PATENT DOCUMENTS

| | | | |
|---|---|---|---|
| 4,096,341 | 6/1978 | Frazer | 560/85 |
| 4,198,520 | 4/1980 | Samour et al. | 560/83 |
| 4,214,068 | 7/1980 | Schreurs et al. | 528/98 |

*Primary Examiner*—Werren B. Lone
*Assistant Examiner*—Vera C. Clarke
*Attorney, Agent, or Firm*—Flehr, Hohbach, Test, Albritton & Herbert

[57] ABSTRACT

Sizing agents characterized as containing bisphenol-polyalkylene glycol etherester copolymer of a specified structure are particularly suited for coating carbon fibers for unsaturated polyester matrix resinous composites.

1 Claim, No Drawings

SIZING AGENTS FOR CARBON FIBERS

BACKGROUND OF THE INVENTION

This invention relates to sizing agents for carbon fibers.

Carbon fiber reinforced plastics (CFRP), which are composites of carbon fibers with a matrix resin such as epoxy resins, unsaturated polyester resins and polyamide resins, are among the most desirable materials from the point of view of specific modulus and specific strength and are rapidly coming to be used in aerospace and other industries because of their superior qualities and light weight. Carbon fibers which are used for the production of CFRP are unidirected into the form of filaments or tows and are combined with a matrix resin after they are made into strands or sheets, woven or knit. Since carbon fibers are basically a brittle substance which does not elongate easily, fluffs tend to be produced by mechanical friction during processing if they are used directly without any pretreatment. Difficulty in their handling becomes a problem and the mechanical properties of CFRP obtained therefrom are also adversely affected. It is therefore a common practice to coat such carbon fibers with a sizing agent in order to improve their cohesiveness and abrasion resistance. This invention relates to sizing agents for carbon fibers to be combined with an unsaturated polyester matrix resin.

Examples of prior art sizing agent for coating carbon fibers to be combined with an unsaturated polyester matrix resin include those which use epoxidized polybutadiene (Japanese Patent Publication Tokkai 56-4335), those which use a mixture of bisphenol diglycidyl ether and a prepolymer derived from diallyl phthalate (Japanese Patent Publication Tokkai 59-228083), those of a water emulsion type having as indispensable constituents an epoxy resin, a condensation product of an unsaturated dibasic acid and oxyalkylated bisphenol, and oxyalkylene derivative of phenol (U.S. Pat. No. 4,167,538) and those using an unsaturated epoxy compound as coupling agent (U.S. Pat. No. 4,163,003).

Although these prior art sizing agents have their own advantages, they still involve serious problems related to the production of CFRP as well as their mechanical properties such as fluffs and yarn breakage at the time of weaving because of the low cohesiveness and abrasion resistance of carbon fibers, danger of toxicity and flammability because an organic solvent is used, and low interlaminar shear strength (ILSS) of produced CFRP because of poor adhesiveness between carbon fibers and unsaturated polyester matrix resins.

SUMMARY OF THE INVENTION

It is therefore an object of the present invention to provide a new sizing agent for carbon fibers with which the problems discussed above can be eliminated. The present invention has been completed as a result of diligent studies by the present inventors in view of the above and other objects and is based on their discovery that bisphenol-polyalkylene glycol etherester copolymers of a special kind are desirable compounds.

DETAILED DESCRIPTION OF THE INVENTION

This invention relates to sizing agents which are for coating carbon fibers for an unsaturated polyester matrix resinous composite and are characterized as containing a bisphenol-polyalkylene glycol etherester copolymer shown by the following formula:

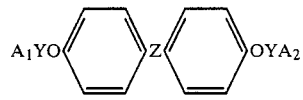

where Y is

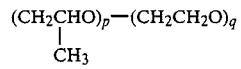

the segments inside parentheses being a block or random copolyether, p being 0 or an integer 1–10, q being 0 or an integer 1–20, and (p+q) being equal to or greater than 1, Z is

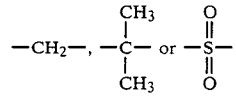

and $A_1$ and $A_2$ may be identical or different and are

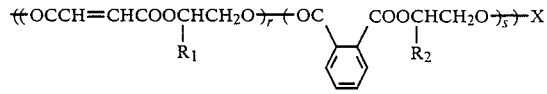

$R_1$ and $R_2$ being identical or different and H or $CH_3$, X being

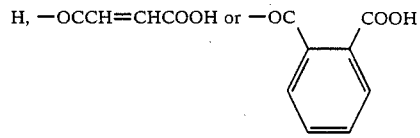

the segments inside parentheses being a block or random copolyether, r and s being 0 or an integer 1–15, and (r+s) being equal to or smaller than 15 and equal to or greater than 1.

Compounds of the present invention shown by the aforementioned formula are polyesters synthesized from polyoxyalkylene bisphenol ether, maleic acid anhydride and/or phthalic acid anhydride, and alkylene oxide. In the formula, propylene oxide (abbreviated as PO) and ethylene oxide (abbreviated as EO) in Y (that is, the polyoxyalkylene part) are block and random copolyethers. The repetition numbers r and s of the polyester part may be zero or in the range of 1–15 but their preferable range is 2–6 in order to satisfy both requirements of affinity with unsaturated polyester matrix resins and wettability of carbon fibers.

In addition to a bisphenol-polyalkylene glycol etherester of the type shown above, the sizing agent according to the present invention may also contain, if necessary, a prior art sizing agent, a lubricant, an emulsifier and the like appropriately as long as the effects achievable by the present invention are not affected. Examples of prior art sizing agent which may be contained include epoxy compounds such as bisphenol-A diglycidyl ethers, epoxy phenol novolac resins, and N,N,N',N'-tetraglycidyl diaminodiphenylmethane. Examples of lubricant include aliphatic esters such as stearyl laurate and oleyl oleate. Examples of emulsifier include those obtainable by block or random addition of EO and/or PO to a phenol compound such as alkyl phenol, phenylethylated phenol, phenylethylated phenylphenol, phenylethylated cumylphenol, phenylmethylated phenol and phenylmethylated cumylphenol. More specifically, examples of emulsifier include non-ionic surfactants such as polyoxyethylene (6 mol) nonylphenylether, polyoxyethylene (70 mol) styrenated (5 mol) cumylphenylether, and polyoxyethylene (30 mol) tribenzylated phenylether. In all situations, the sizing agent of the present invention should contain a compound shown by aforementioned formula by 50 wt % or greater and more preferably by 70 wt % or greater and an emulsifier of the aforementioned type by 30 wt % or less.

Matrix resins to which the present invention is applicable are unsaturated resins with polyester linkage and include $\alpha,\beta$-unsaturated polyester resins and vinyl ester resins. Aforementioned $\alpha,\beta$-unsaturated polyester resins are obtained by dissolving in a styrene monomer or another vinyl monomer an unsaturated polyester obtainable by condensation of $\alpha,\beta$-unsaturated dicarboxylic acid and glycol. Saturated dicarboxylic acid or aromatic dicarboxylic acid may be used supplementarily as dibasic carboxylic acid.

Examples of $\alpha,\beta$-unsaturated dicarboxylic acid include maleic acid, fumaric acid, itaconic acid, citraconic acid and anhydrides of these dicarboxylic acids. Examples of dicarboxylic used supplementarily include succinic acid, phthalic anhydride, o-pathalic acid, isophthalic acid and terephthalic acid.

Examples of glycol include ethylene glycol, 1,2-propylene glycol and 1,3-propylene glycol.

Examples of olefinic unsaturated monomer include styrene, vinyl toluene, divinyl benzene and esters of acrylic acid or methacrylic acid such as methyl methacrylate, butyl acrylate, and trimethylolpropane trmethacrylate Aforementioned vinyl ester resins are obtained by esterification of epoxy resin and acrylic acid or methacrylic acid. Examples of epoxy resins are diglycidyl ethers of bisphenol A derived from bisphenol A and epichlorohydrin, cresol-novolac epoxy resins and phenol-novolac epoxy resins. Novolac resins are produced by reacting phenol or a substituted phenol with formaldehyde in acid solution. The novolacs suitable for reaction with epichlorohydrin contain from about 2 to 6 phenolic hydroxyl groups. These vinyl ester resins have acrylate or methacrylate groups on its terminals. Main chain of these vinyl ester resin is constituted from bisphenol or novolac molecular structure. They are mixed with styrene monomer or the like.

The rate at which a sizing agent of the present invention would be attached to carbon fibers is generally 0.1–5.0 wt % with respect to the carbon fibers and more preferably 0.5–3.0 wt %. application in the form of a water dispersant is favorable but use may also be made of appropriate organic solvents. The preferred concentration of sizing solution, when it is used, is 0.5–5 wt %. The amount finally attached to carbon fibers may be controlled by a mangle roller after impregnation or by the rotational velocity of an oiling roller and the coating density. After attachment, an appropriate method may be used for drying to complete a sizing process.

Sizing agents of the present invention are particularly effective to carbon fibers from pitch and carbon fibers obtained by heating a precursor of acrylic filaments. They can eliminate the problems of prior art agents and significantly improve the processability of carbon fibers in later processing steps. For example, they can reduce fluffs and yarn breakage while carbon fiber filaments and tows are wound up or during a weaving process although they are bent repeatedly by guides and rollers. Provided with superior cohesiveness and lubricity, carbon fiber yarns can be wound and woven more speedily and this contributes to improved productivity. Moreover, no organic solvent is needed and they can be applied to carbon fibers directly or as a uniform stable aqueous emulsion with only a small amount of nonionic surfactant. This makes them advantageous from the point of view of hygienical safety. In addition to these advantages, sizing agents of the present invention have superior adhesiveness with carbon fibers and matrix resins and hence can improve the interlaminar shear strength of the produced CFRP.

In what follows, test results are described in order to show the effects of the present invention more clearly. For this purpose, the following ten bisphenol-polyalkylene glycol etherester copolymers (A-1 through A-10) shown by the formula given above were prepared:

A-1 with p = 0, q = 5, (i)

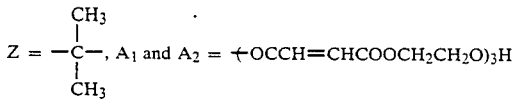

A-2 with p = 2, q = 6, random (ii)

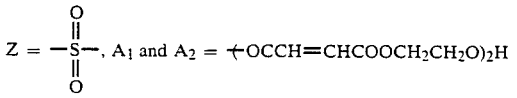

A-3 with p = 0, q = 5, Z as in A-1, (iii)
$A_1$ and $A_2$ = $\text{+OCCH=CHCOOCH}_2\text{CH}_2\text{O)}_6\text{H}$ A-4 with p = 0, q = 4, Z as in A-1, (iv)
$A_1$ and $A_2$ = $\text{—OCCH=CHCOOCH}_2\text{CH}_2\text{OOCCH=CHCOOH}$ A-5 with p = 0, q = 5, Z as in A-1, (v)
$A_1$ and $A_2$ = random

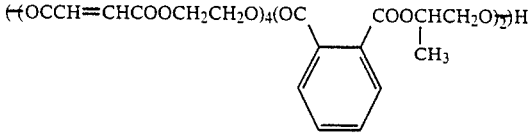

A-6 with p = 0, q = 2, Z as in A-1, (vi)

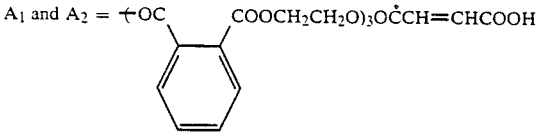

A-7 with p = 5, q = 8, random, Z as in A-1, (vii)
$A_1$ and $A_2$ = $\text{+OCCH=CHCOOCH}_2\text{CH}_2\text{O)}_6\text{H}$ A-8 with p = 2, q = 0, Z as in A-1, (viii)
$A_1$ and $A_2$ = $\text{+OCCH=CHCOOCH}_2\text{CH}_2\text{O)}_2\text{H}$ A-9 with p = 2, q = 4, block, Z as in A-1, (ix)
$A_1$ and $A_2$ = $\text{+OCCH=CHCOOCH}_2\text{CH}_2\text{O)}_2\text{H}$ A-10 with p = 1, q = 0, Z as in A-1, (x)

-continued $A_1$ and $A_2$ = 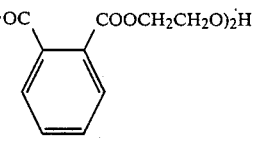

The chemical formula for A-5, for example, is

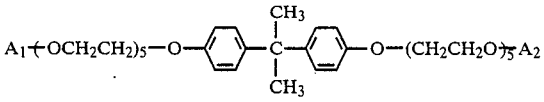

where $A_1$ and $A_2$ are groups as shown above with a random linkage inside the outer parentheses.

Synthesis of A-1: 1335 g (2.0 mol) of an EO (10 mol) adduct of bisphenol A, 1176 g (12.0 mol) of maleic acid anhydride and 1.0 g of tetramethyl ammonium bromide as catalyst were placed inside a 5-liter autoclave and agitated at 120°–125° C. for 30 minutes. Thereafter, 535 g (12.16 mol) of EO was infused at 125° C. over a period of four hours for a reaction and a light brown viscous liquid (A-1) was obtained as reaction product. Its acid value was 3.4 and its (polystyrene-converted) average molecular weight by GPC (gel permeation chromatography) was 1600. A-2 through A-10 were also synthesized in similar manners and sizing liquids (Test Examples 1–10 and Comparison Examples 1–4) shown in Table 1 were prepared therefrom for testing. Tests conducted therewith are described below and results are shown in Table 2.

To test stability of emulsion, each sizing liquid with 20 percent solid component (Comparison Example 4 having been adjusted to 20 percent solid component) was left for seven days at 20° C. and their separation conditions were evaluated as follows:

A = no separation,
B = creamy separation floating,
C = precipitation,
D = both creamy separation and precipitation.

Unsized carbon fibers by heating a precursor of acrylic filaments (7μ/6000 filaments) were impregnated by each sizing liquid by dipping such that the attached effective component was 1.3 wt %. After they were squeezed by rollers and dried, they were subjected to a heat treatment inside an oven at 150° C. for 30 minutes. Fiber-metal rubbing friction was tested with each of these sized carbon fibers by means of a TM type yarn friction and rubbing tester (product of Daiei Kagaku Seiki Company) with a load of 100 g/6000 fialments, $\theta = 150°$; rubbing distance = 30 mm and by moving a metallic comb 500 times reciprocatingly at the rate of 150 times/min. In addition, a rubbing tester (product of Toyo Seiki Company) was used with internal angle about 35°, one twist, rubbing distance = 20 mm and by 500 times of reciprocating motion at the rate of 100 times/min. to examine fiber-fiber friction. Results of these examinations were evaluated as follows:

A = hardly any fluffs or yarn breakages
B = fluffs appearing only singly
C = fluffs and yarn breakages appearing collectively
D = many fluffs and yarn breakages with a cut at one place
E = 6000 filaments cut Carbon fibers which had been sized as above were unidirected and impregnated uniformly with a resin mixture composed of 100 weight parts of RIPOXY R-802 (produced by Showa Kobunshi Company) which is a vinyl ester resin, 1 weight part of tertiary butylperbenzoate and 1 weight part of butylbenzoate peroxide to produce unidirected composites by a molding method (130° C. × 7 kg/cm² × 1 hour). Their carbon fiber contents were 60 volume percent and their dimensions were 2.5 mm (thickness) × 6 mm (width × 17 mm (length). The interlaminar shear strength of each composite was measured with the ratio of span/thickness = 5.

The results demonstrated in Table 2 clearly show that sizing agents according to the present invention have superior emulsion stability, significantly reduced fluffs and yarn breakages, improved processability of carbon fibers and increased interlaminar shear strength of the CFRP produced from sized carbon fibers.

TABLE 1

| | Test Examples | | | | | | | | | | Comparison | | | |
|---|---|---|---|---|---|---|---|---|---|---|---|---|---|---|
| | 1 | 2 | 3 | 4 | 5 | 6 | 7 | 8 | 9 | 10 | 1 | 2 | 3 | 4 |
| A-1 | 19 | | | | | | | | | | | | | |
| A-2 | | 20 | | | | | | | | | | | | |
| A-3 | | | 20 | | | | | | | | | | | |
| A-4 | | | | 20 | | | | | | | | | | |
| A-5 | | | | | 19 | | | | | | | | | |
| A-6 | | | | | | 18 | | | | | | | | |
| A-7 | | | | | | | 18 | | | | | | | |
| A-8 | | | | | | | | 17 | | | | | | |
| A-9 | | | | | | | | | 18 | | | | | |
| A-10 | | | | | | | | | | 18 | | | | |
| *1 | | | | | | | | | | | 1.7 | | | |
| *2 | | | | | | | | | | | | 2.0 | | |
| *3 | | | | | | | | | | | | | 1.0 | 30 |
| *4 | | | | | | | | | | | | | 0.5 | |
| *5 | | | | | | | | | | | | | | 20 |
| *6 | | | | | | | | | | | | | | 5 |
| *7 | | | | | | | 0.3 | 1 | | | | | | |
| *8 | 1 | | | | 1 | 2 | 1.7 | 2 | 2 | 2 | | | | |
| water | 80 | 80 | 80 | 80 | 80 | 80 | 80 | 80 | 80 | 80 | | | | 45 |
| acetone | | | | | | | | | | | 98.3 | | 98.5 | |

TABLE 1-continued

| | Test Examples | | | | | | | | | | Comparison | | | |
|---|---|---|---|---|---|---|---|---|---|---|---|---|---|---|
| | 1 | 2 | 3 | 4 | 5 | 6 | 7 | 8 | 9 | 10 | 1 | 2 | 3 | 4 |
| *9 | | | | | | | | | | | | 98.0 | | |

Notes: Numbers in table represent wt %
*1: Epoxidized polybutadiene (BF-1000 produced by Adeka Argus Chemical).
*2: Allyl glycidyl ether
*3: Bisphenol-A diglycidyl ether (Epikote 828 produced by Yuka Shell Chemical : Epoxy equivalent of 190).
*4: Diallyl phthalate prepolymer (Daisodap A produced by Osaka Soda.
*5: Condensate of 2.0 mol of poyethylene glycol (2 mol) added bisphenol A, 1.5 mol of maleic acid and 0.5 mol of sebacic acid.
*6: Polyoxyethylene (70 mol) penta (phenyl ethylated) cumyl phenyl ether.
*7: Polyoxyethylene (6 mol) nonylphenyl ether
*8: Polyoxyethylene (30 mol) tribenzylated phenol
*9: Ethylene dichloride

TABLE 2

| Examples | TM Test | Fluffs, Yarn Breakage: Rubbing Test | ILSS ($Kg/mm^2$) | Emulsion Stability |
|---|---|---|---|---|
| | | Test | | |
| 1 | A | B | 8.1 | A |
| 2 | A | A | 8.4 | A |
| 3 | B | A | 8.4 | A |
| 4 | A | A | 8.6 | A |
| 5 | A | A | 8.4 | A |
| 6 | A | A | 8.6 | A |
| 7 | A | A | 8.4 | A |
| 8 | A | B | 8.3 | A |
| 9 | A | A | 8.5 | A |
| 10 | B | A | 8.4 | A |
| | | Comparison | | |
| 1 | D | D | 7.0 | — |
| 2 | E | E | 6.8 | — |
| 3 | C | B-C | 7.0 | — |
| 4 | C | B | 7.5 | A |

What is claimed is:

1. A sizing agent for carbon fibers consisting of bisphenol-polyalkylene glycol etherester copolymer shown by the following formula:

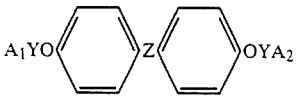

where Y is

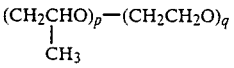

the segments inside parentheses being a block or random copolyether, p being 0 or an integer 1-10, q being 0 or an integer 1-20, and (p+q) being equal to or greater than 1, Z is

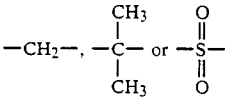

and $A_1$ and $A_2$ may be identical or different and are

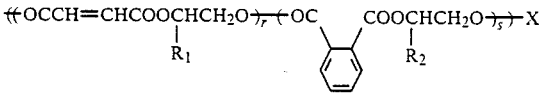

$R_1$ and $R_2$ being identical or different and H or $CH_3$, X being

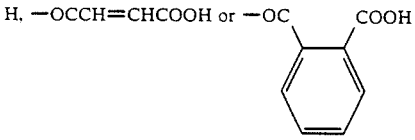

the segments inside parentheses being a block or random copolyether, r and s being 0 or an integer 1-15, and (r+s) being equal to or smaller than 15 and equal to or greater than 1.

* * * * *